US006867399B2

(12) United States Patent
Muegge et al.

(10) Patent No.: US 6,867,399 B2
(45) Date of Patent: Mar. 15, 2005

(54) METHODS AND APPARATUS FOR OPERATING A SPEEDCOOKING OVEN

(75) Inventors: Coleen Judith Muegge, Louisville, KY (US); Jennifer Elizabeth Rael, Louisville, KY (US); Karen Edberg, Louisville, KY (US); Alicia A. Doligale, Prospect, KY (US); Larry R. Harmon, Louisville, KY (US); Cecilia Maria Blanchard, Louisville, KY (US)

(73) Assignee: General Electric Company, Schenectady, NY (US)

( * ) Notice: Subject to any disclaimer, the term of this patent is extended or adjusted under 35 U.S.C. 154(b) by 27 days.

(21) Appl. No.: 10/389,307

(22) Filed: Mar. 14, 2003

(65) Prior Publication Data

US 2004/0178192 A1 Sep. 16, 2004

(51) Int. Cl.[7] ..... H05B 6/64
(52) U.S. Cl. ..... 219/681; 219/685
(58) Field of Search ..... 219/681, 506, 219/412, 494, 685, 719, 497, 505, 706, 411–413; 99/325, 329, 339, 330, 331

(56) References Cited

U.S. PATENT DOCUMENTS 4,332,992 A * 6/1982 Larsen et al. ..... 219/681
5,147,993 A * 9/1992 Braun et al. ..... 219/685
5,317,130 A 5/1994 Burkett et al.
5,352,874 A 10/1994 Gong
5,548,104 A 8/1996 Ko
5,756,970 A 5/1998 Barger et al.
6,005,229 A 12/1999 Brown et al.
6,114,664 A * 9/2000 Cook et al. ..... 219/400
6,252,206 B1 * 6/2001 Leukhardt et al. ..... 219/486
2003/0024925 A1 * 2/2003 Graves et al. ..... 219/681
2003/0098888 A1 * 5/2003 Guenther et al. ..... 345/810

* cited by examiner

*Primary Examiner*—Quang T. Van
(74) *Attorney, Agent, or Firm*—H. Neil Houser, Esq.; Armstrong Teasdale LLP

(57) ABSTRACT

A method for operating an oven including a microcomputer includes receiving in a microprocessor of an oven, a plurality of inputs from a user indicative of a conventional cooking time, a conventional cooking temperature, and a food category, wherein the oven includes an RF generation module, an upper heater module, a lower heater module, and a convection fan, and converting at least one of the conventional cooking time to a speedcooking time different than the conventional cooking time, and the conventional cooking temperature to a speedcooking temperature.

21 Claims, 11 Drawing Sheets

| Mode | Sub-cooking Mode | Standard Cook Time (Z Parameter) | Speed | Preheat (P Parameter) | | | | | | Cooking Cycle (X Parameter) | |
|---|---|---|---|---|---|---|---|---|---|---|---|
| | | | | Elements | Toff Temp | Conv Fan | 1st Fan - CW | 3rd Fan - CCW | 2nd & 4th Fan - off time | Stage | Time (t) |
| Baked Goods | N/A | <25 Minutes | 2X | Bake 100% Conv 100% | Tcook + 29 | On[14] | 30 sec | 30 sec | 10 sec | Stage 1 | t<tcook |
| | | ≥25 Minutes | 1.8x | BakeYsecOn/(60 Y)secOff BroilYsecOff/(60 Y)secsOn Conv 100% Y=40 | Tcook + 64 | On[14] | 25 min | 45 sec | 10 sec | Stage 1 | t<.03 tcook |
| | | | | | | | | | | Stage 2 | .03t<t<1/2 tcook |
| | | | | | | | | | | Stage 3 | .5tcook<t <.6tcook |
| | | | | | | | | | | Stage 4 | t>.6 tcook |
| Veg/ Casserole | N/A | All Times | 4X | Bake 100% Conv 100% | Tcook + 29 | On[14] | 3 min | 3 min | 10 sec | Stage 1 | t<tcook |
| Poultry/ Seafood | N/A | <2.5 hours | 3X | BakeYsecOn/(60 Y)secOff BroilYsecOff/(60 Y)secsOn Conv 100% Y=45 | Tcook + 79 | On[14] | 5 min | 5 min | 10 sec | Stage 1 | t<tcook |
| | | >2.5 hours | 2X | Bake 100% Conv 100% | Tcook - 21 | On[14] | 5 min | 5 min | 10 sec | Stage 1 | t<tcook |
| Meat | N/A | <1.5 hours | 3X | Bake 100% Conv 100% | Tcook + 29 | On[14] | 5 min | 5 min | 10 sec | Stage 1 | t<tcook |
| | | >1.5 hours | 2.5X | Bake 100% Conv 100% | Tcook + 29 | On[14] | 5 min | 5 min | 10 sec | Stage 1 | t<tcook |

FIG. 10A

| | Cooking Cycle (X Parameter) | | | | | | | | Other EEPROM Parameters | | |
|---|---|---|---|---|---|---|---|---|---|---|---|
| | Parallel Loads | | | | | Series Loads ONLY | | | | | |
| Cycle Temp | Microwave | Conv Fan | 1st Fan-CW | 3rd Fan-CCW | 2nd & 4th Fan-off time | Bake | Broil | Conv | Toff | Toffset | Tswing |
| Heat Cavity when RTD < Toff - Tswing Stop Heating when RTD > Toff | 7s On/ 23s Off | On | 30 sec | 30 sec | 10 sec | Off | Off | 30secOn/ 10secOff | Tcook + Toffset + Tuser offset | -6 | 8 |
| | Off | Off | Off | Off | Off | 1st [Bake Heat ON Time/Post-Bake Heat OFF Time] 15 sec On/ 5sec Off | 2nd [Broil Heat ON Time/Post-Broil Heat OFF Time] 8 sec On/ 10sec Off | Off | | 64 | 8 |
| | Off | Off | Off | Off | Off | 1st [Bake Heat ON Time/Post-Bake Heat OFF Time] 15 sec On/ 5sec Off | 2nd [Broil Heat ON Time/Post-Broil Heat OFF Time] 8 sec On/ 10sec Off | Off | | 64 | 8 |
| | 7s On/ 23s Off | Off | Off | Off | Off | 1st [Bake Heat ON Time/Post-Bake Heat OFF Time] 15 sec On/ 5sec Off | 2nd [Broil Heat ON Time/Post-Broil Heat OFF Time] 8 sec On/ 10sec Off | Off | | 64 | 8 |
| | 7s On/ 23s Off | On | 25 sec | 45 sec | 10 sec | 1st [Bake Heat ON Time/Post-Bake Heat OFF Time] 15 sec On/ 5sec Off | 2nd [Broil Heat ON Time/Post-Broil Heat OFF Time] 8 sec On/ 10sec Off | Off | | 64 | 8 |
| | 100% | On | 3 min | 3 min | 10 sec | Off | Off | 60secOn/ 0secOff | | 29 | 8 |
| | 100% | On | 5 min | 5 min | 10 sec | 1st 45 sec On | 2nd 15 sec on | Off | | 79 | 8 |
| | 180s On/ 45s Off | On | 5 min | 5 min | 10 sec | Off | Off | On | | -21 | 8 |
| | 5min On/ 1min Off | On | 5 min | 5 min | 10 sec | Off | Off | On | | 29 | 8 |
| | 3min On/ 5.75min Off | On | 5 min | 5 min | 10 sec | Off | Off | On | | 29 | 8 |

FIG. 10B

| Mode | Sub-cooking Mode | Standard Cook Time (Z Parameter) | Speed | Preheat (P Parameter) | | | | | | Cooking Cycle (X Parameter) | |
|---|---|---|---|---|---|---|---|---|---|---|---|
| | | | | Elements | Toff Temp | Conv Fan | 1st Fan - CW | 3rd Fan - CCW | 2nd & 4th Fan - off time | Stage | Time (t) |
| Breads | Breads Low (when tcook< Bake Band Break Temp(470)) | <25 Minutes | 3X | Bake 100% Conv 100% | Tcook + 54 | On[14] | 25 sec | 45 sec | 10 sec | Stage 1 | t<tcook |
| | | >25 Minutes | 3X | Bake 100% Conv 100% | Tcook + 54 | On[14] | 3 min | 3 min | 10 sec | Stage 1 | 0<t<.15tcook |
| | | | | | | | | | | Stage 2 | .15tcook< t<.35tcook |
| | | | | | | | | | | Stage 3 | .35tcook< t<.5tcook |
| | | | | | | | | | | Stage 4 | .5tcook< t<tcook |
| | Breads High (when tcook< Bake Band Break Temp(470)) | <25 Minutes | 3X | Bake 100% Conv 100% | Tcook + 4 | On[14] | 25 sec | 45 sec | 10 sec | Stage 1 | t<tcook |
| | | >25 Minutes | 3X | Bake 100% Conv 100% | Tcook + 4 | On[14] | 3 min | 3 min | 10 sec | Stage 1 | 0<t<.15tcook |
| | | | | | | | | | | Stage 2 | .15tcook< t<.35tcook |
| | | | | | | | | | | Stage 3 | .35tcook< t<.5tcook |
| | | | | | | | | | | Stage 4 | .5tcook< t<tcook |
| Frozen Foods | N/A | <23 Minutes | 3X | Bake 100% Conv 100% | Tcook + 29 | On[14] | 30 sec | 30 sec | 10 sec | Stage 1 | t<tcook |
| | | 23-40 Minutes | 2X | Bake 100% Conv 100% | Tcook + 29 | On[14] | 25 sec | 45 sec | 10 sec | Stage 1 | t<tcook |
| | | > 40 Minutes | 2X | Bake 100% Conv 100% | Tcook - 246 | On[14] | 3 min | 3 min | 10 sec | Stage 1 | t<.33tcook |
| | | | | | | | | | | Stage 2 | .33tcook< t<.5tcook |
| | | | | | | | | | | Stage 3 | .5tcook< t<tcook |
| Speed Broil | N/A | All Times | 2X | Bake 100% Conv 100% | 304 | On[14] | 30 sec | 30 sec | 10 sec | Stage 1 | All times |

FIG. 10C

| | Cooking Cycle (X Parameter) | | | | | | | | Other EEPROM Parameters | | |
|---|---|---|---|---|---|---|---|---|---|---|---|
| | Parallel Loads | | | | | Series Loads ONLY | | | | | |
| Cycle Temp | Microwave | Conv Fan | 1st Fan-CW | 3rd Fan-CCW | 2nd & 4th Fan-off time | Bake | Broil | Conv | Toff | Toffset | Tswing |
| Heat Cavity when RTD < Toff - Tswing Stop Heating when RTD > Toff | 20s On/10s off | On | 25 sec | 45 sec | 10 sec | Off | Off | 50secOn/ 10secOff | | 54 | 8 |
| | Off | On | 3 min | 3 min | 10 sec | On | Off | Off | | 54 | 8 |
| | 100% | On | 3 min | 3 min | 10 sec | On | Off | Off | | 54 | 8 |
| | Off | On | 3 min | 3 min | 10 sec | On | Off | Off | | 54 | 8 |
| | 100% | On | 3 min | 3 min | 10 sec | On | Off | Off | | 54 | 8 |
| | 20s On/10s off | On | 25 sec | 45 sec | 10 sec | Off | Off | 50secOn/ 10secOff | | 4 | 8 |
| | Off | On | 3 min | 3 min | 10 sec | On | Off | Off | | 4 | 8 |
| | 100% | On | 3 min | 3 min | 10 sec | On | Off | Off | | 4 | 8 |
| | Off | On | 3 min | 3 min | 10 sec | On | Off | Off | | 4 | 8 |
| | 100% | On | 3 min | 3 min | 10 sec | On | Off | Off | | 4 | 8 |
| | 100% | On | 30 sec | 30 sec | 10 sec | Off | Off | On | | 29 | 8 |
| | 20s On/10s off Off | On | 25 sec | 45 sec | 10 sec | Off | Off | 50secOn/ 10secOff | | 29 | 8 |
| | 100% | On | 3 min | 3 min | 10 sec | 1st 30secOn | Off | 2nd 30secOn | | -96 | 8 |
| | 2 min on/ 1 min off | On | 3 min | 3 min | 10 sec | 1st 30secOn | Off | 2nd 30secOn | | -96 | 8 |
| | 2 min on/ 1 min off | On | 3 min | 3 min | 10 sec | 1st 30secOn | Off | 2nd 30secOn | | -46 | 8 |
| | 24sec on/ 6sec off | Off | 30 sec | 30 sec | 10 sec | Off | On | Off | SpeedBroil Toff (Hi) = 550F | N/A | 8 |

FIG. 10D

METHODS AND APPARATUS FOR OPERATING A SPEEDCOOKING OVEN

This invention relates generally to ovens and, more particularly, to an oven operable in speedcooking, microwave, and convection/bake modes.

Ovens typically are either, for example, microwave, radiant, or thermal/convection cooking type ovens. For example, a microwave oven includes a magnetron for generating RF energy used to cook food in an oven cooking cavity. Although microwave ovens cook food more quickly than radiant or thermal/convection ovens, microwave ovens do not brown the food. Microwave ovens therefore typically are not used to cook as wide a variety of foods as radiant or thermal/convection ovens.

Radiant cooking ovens include an energy source such as lamps or resistive sheath elements which generate radiant energy used to cook the food. Radiant ovens brown the food and generally can be used to cook a wider variety of foods than microwave ovens. Radiant ovens, however, cook many foods slower than microwave ovens.

In thermal/convection ovens, the food is cooked by the air in the cooking cavity, which is heated by a heat source. Standard thermal ovens do not have a fan to circulate the hot air in the cooking cavity. Some convection ovens use the same heat source as a standard thermal oven, but add a fan to increase cooking efficiency by circulating the hot air around the food. Other convection ovens include a separate convection element. Such ovens, however, may not cook as fast as radiant or microwave ovens.

One way to achieve speedcooking in an oven is to include both microwave and radiant energy sources. The combination of microwave and radiant energy sources facilitates fast cooking of foods. In addition, and as compared to microwave only cooking, a combination of microwave and radiant energy sources can cook a wider variety of foods.

While speedcooking ovens are versatile and cook food quickly, operating a speedcooking oven based on operational parameters such as cooking time and temperature received from an operator based on the operators cooking knowledge using a conventional oven results in food that may not be cooked to the desired preference. For example, since speed cooking ovens, generally cook food more quickly, entering conventional oven parameters for cooking temperature and cooking time may result in the food being overcooked or burned.

BRIEF SUMMARY OF THE INVENTION

In one aspect, a method for operating an oven including a microcomputer is provided. The method includes receiving in a microprocessor of an oven, a plurality of inputs from a user indicative of a conventional cooking time, a conventional cooking temperature, and a food category, wherein the oven includes an RF generation module, an upper heater module, a lower heater module, and a convection fan, and converting at least one of the conventional cooking time to a speedcooking time different than the conventional cooking time, and the conventional cooking temperature to a speedcooking temperature In another aspect, an oven including a cooking cavity is provided. The oven also includes an RF generation module for delivering microwave energy into the cooking cavity, an upper heater module including at least one heat source for convection cooking, a lower heater module, a convection fan, and a microprocessor operatively connected to the RF generation module, the upper heater module, the lower heater module, and the convection fan. The microprocessor is configured to receive a plurality of inputs from a user indicative of a conventional cooking time, a conventional cooking temperature, and a food category, and convert at least one of the conventional cooking time to a speedcooking time different than the conventional cooking time, and the conventional cooking temperature to a speedcooking temperature different than the conventional cooking temperature using a cooking algorithm.

In a further aspect, a microprocessor electrically coupled to an oven is provided. The microprocessor is programmed to receive, with an oven including an RF generation module, an upper module, a lower module, and a convection fan, a plurality of inputs from a user indicative of a conventional cooking time, a conventional cooking temperature, and a food category, convert at least one of the conventional cooking time to a speedcooking time different than the conventional cooking time, and the conventional cooking temperature to a speedcooking temperature different than the conventional cooking temperature using a cooking algorithm, operate at least one of the RF generation module, the upper module, the lower module, and the convection fan based on the cooking algorithm, and periodically update the cooking algorithm during a cooking cycle.

BRIEF DESCRIPTION OF THE DRAWINGS

FIG. 10A illustrates a first portion of an exemplary algorithm that can be used with the method shown in FIG. 9.

FIG. 10B illustrates a second portion of an exemplary algorithm that can be used with the method shown in FIG. 9.

FIG. 10C illustrates a third portion of an exemplary algorithm that can be used with the method shown in FIG. 9.

FIG. 10D illustrates a fourth portion of an exemplary algorithm that can be used with the method shown in FIG. 9.

DETAILED DESCRIPTION OF THE INVENTION

In the exemplary embodiment, the methods and apparatus described herein are applicable to the operation of an oven that includes sources of radiant and microwave energy as well as a convection heating element, a bake heating element, and a broiler heating element. Although three specific embodiments of such an oven are described herein, it should be understood that the present invention can be utilized in combination with many other such ovens and is not limited to practice with the ovens described herein. For example, one oven described herein below is a speedcook oven including a range. The present invention, however, is not limited to practice with just full-size ovens that include a rangetop, but can be used with many other types of ovens such as countertop or built-in wall ovens, over the range type ovens, and a double wall oven.

Figure 1:
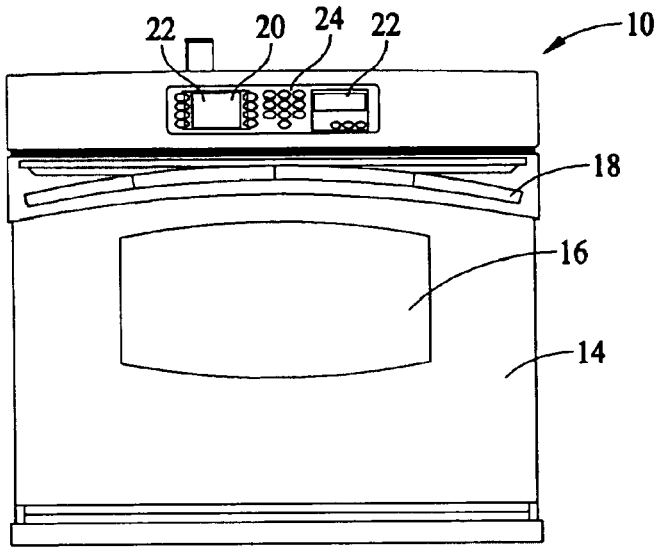
FIG. 1 is a front view of a speedcook wall oven.
Figure 2:
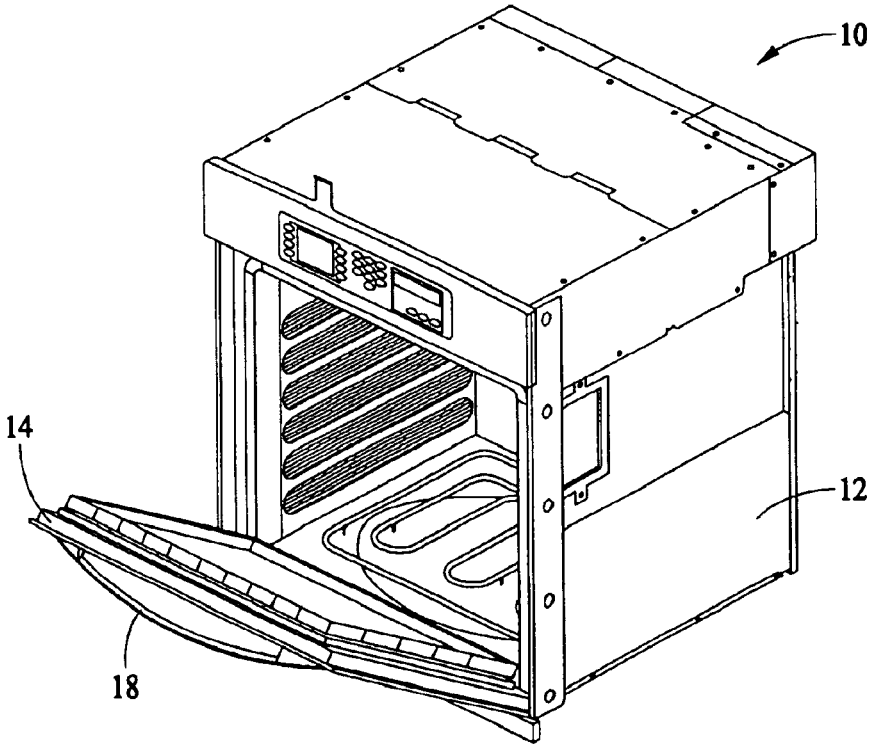
FIG. 2 is a perspective view of the oven shown in FIG. 1.
Figure 3:
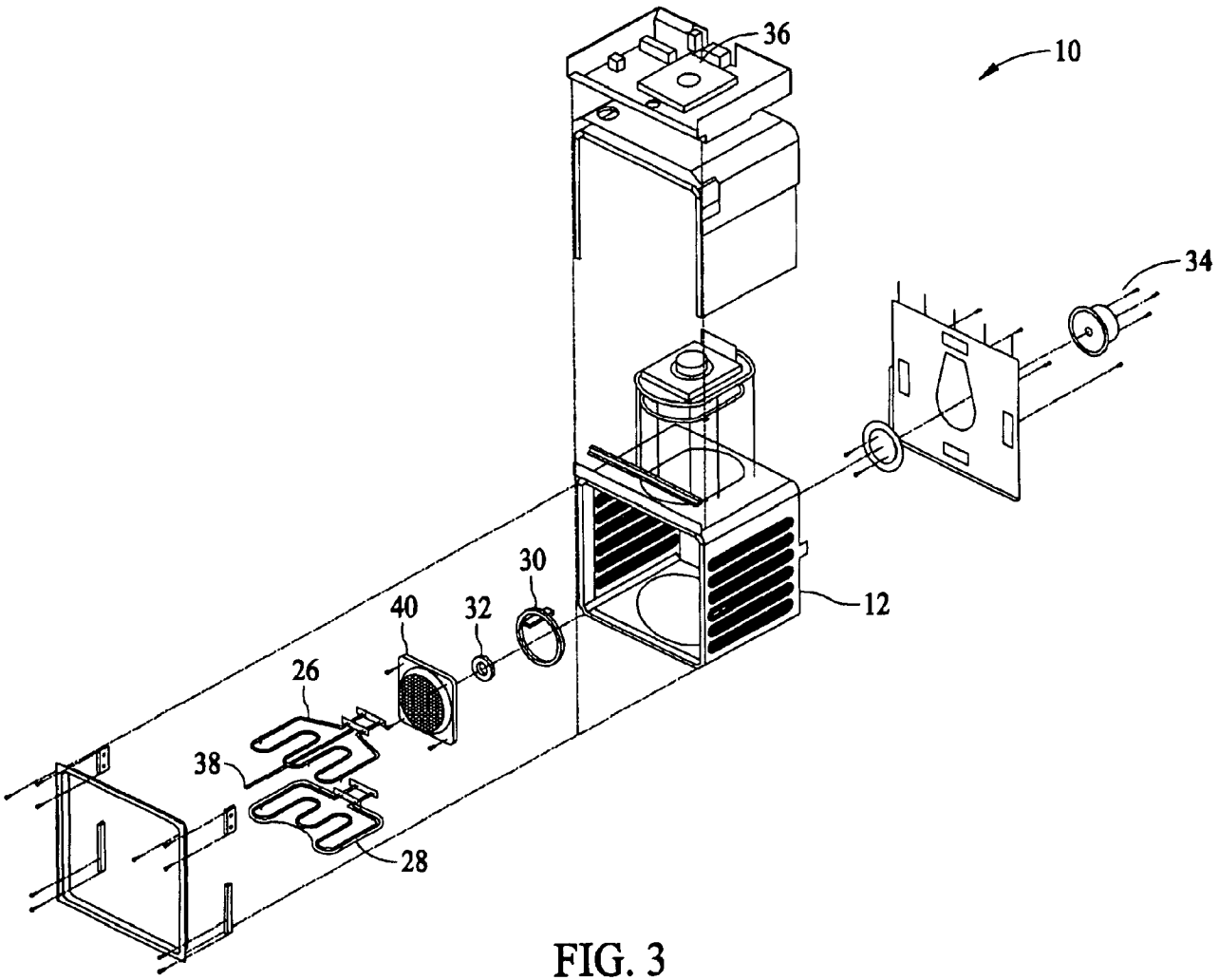
FIG. 3 is an exploded view of the oven shown in FIG. 1 and FIG. 2.

FIG. 1 is a front view of a speedcook oven 10. FIG. 2 is a perspective view of speed cook oven 10. FIG. 3 is an exploded view of the oven shown in FIG. 1 and FIG. 2. In the exemplary embodiment, speedcook oven 10 includes an oven cavity 12, a door 14 including a window 16 provided for viewing food in oven cooking cavity 12, and a handle 18 secured to door 14. Oven 10 also includes a control panel 20 that includes at least one display 22, a plurality of tactile control buttons 24, and various knobs or dials.

Speedcooking oven 10 includes a broil heating element 26, a bake heating element 28, a convection heating element 30, a convection fan 32, and a convection motor 34 mechanically coupled to convection fan 32 such that heat generated by convection element 30 is provided to oven cavity 12. Speedcooking oven 10 also includes a magnetron 36 and a temperature sensor 38 configured to sense the temperature within cavity 12. Broil heating element 26 is located at a top area inside speedcooking oven 10 and bake heating element 28 is located at a bottom area inside speedcooking oven 10. Convection heating element 30 and convection fan 32 are located at a back area inside speedcooking oven 10. A cover 40 can be provided to shield a user from convection heating element 30 and convection fan 32. Magnetron 36 is located above broil heating element 26.

Magnetron 36 generates microwave energy to speed cook various food items, which are supported by a rack (not shown). The microwaves are evenly distributed inside speedcooking oven 10 by a microwave dispersement plate (not shown) positioned between magnetron 36 and broil heating element 26. The microwave dispersement plate is similar to the match plate described in U.S. Pat. No. 6,452,142. Door 14 of speedcooking oven 10 allows access to speedcooking oven 10. Door 14 includes an interlock (not shown) configured to de-energize magnetron 36 when door 14 is opened while continuing cycling of the other heating elements. In use, broil heating element 26, bake heating element 28, convection heating element 30, and convection fan 32 will continue to operate in accordance with the methods described herein for a first time to allow an operator to enter additional cooking time if desired or to check on the completeness of the food. At the completion of the first time, all heating elements still operating will be de-energized.

Figure 4:
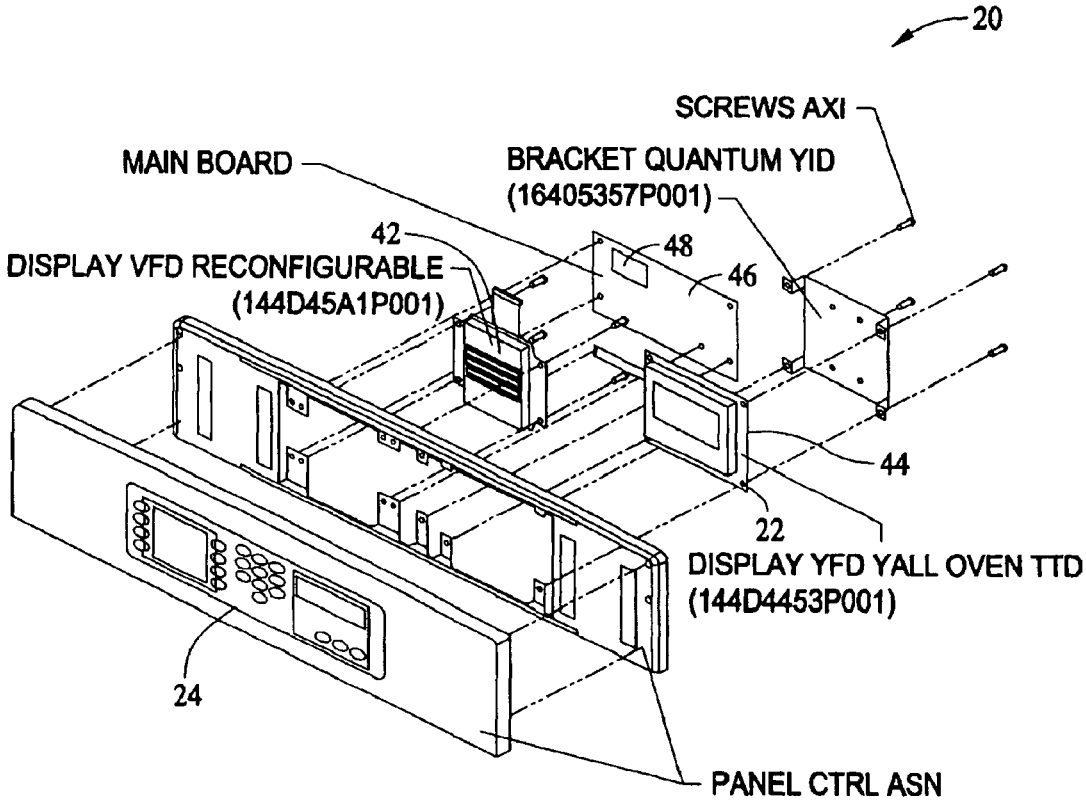
FIG. 4 is an exploded view of control panel that can be used with the oven shown in FIG. 1, FIG. 2, and FIG. 3.

FIG. 4 is an exploded view of control panel 20 that includes a first display 42, a second display 44, and a control board 46. In the exemplary embodiment, first display 42 is an alphanumeric menu display 42 that allows the user to choose between various functions that speedcooking oven 10 performs, and second display 44 is a status display 44 that notifies the user of various conditions inside speedcooking oven 10. For example, status display 44 can notify the user that the temperature inside speedcooking oven 10 is 327 degrees Fahrenheit.

Speedcooking oven 10 also include a microprocessor 48 positioned on a control board 46 and electrically coupled to alphanumeric display 42. Microprocessor 48 is configured to operate various components of oven 10, such as, but not limited to, broiler heating element 26, bake heating element 28, convection fan 32, magnetron 36, and convection heating element 30. In the exemplary embodiment, temperature sensor 38 is located at least partially within cavity 12 and microprocessor 48 is configured to receive an input from temperature sensor 38. Microprocessor 48 is programmed to perform functions described herein, and as used herein, the term microprocessor is not limited to just those integrated circuits referred to in the art as microprocessors, but broadly refers to computers, processors, microcontrollers, microcomputers, programmable logic controllers, application specific integrated circuits, and other programmable logic circuits, and these terms are used interchangeably herein.

In use, cooking selections are made by depressing tactile control buttons 24 and when the desired selection is displayed, pressing a start button. For example, many cooking algorithms can be preprogrammed in the oven memory for many different types of foods. When a user is cooking a particular food item for which there is a preprogrammed cooking algorithm, the preprogrammed cooking algorithm is selected by operating the control buttons 24 until the selected food name is displayed and then pressing a start button. Instructions and selections are displayed on display 44.

Figure 5:
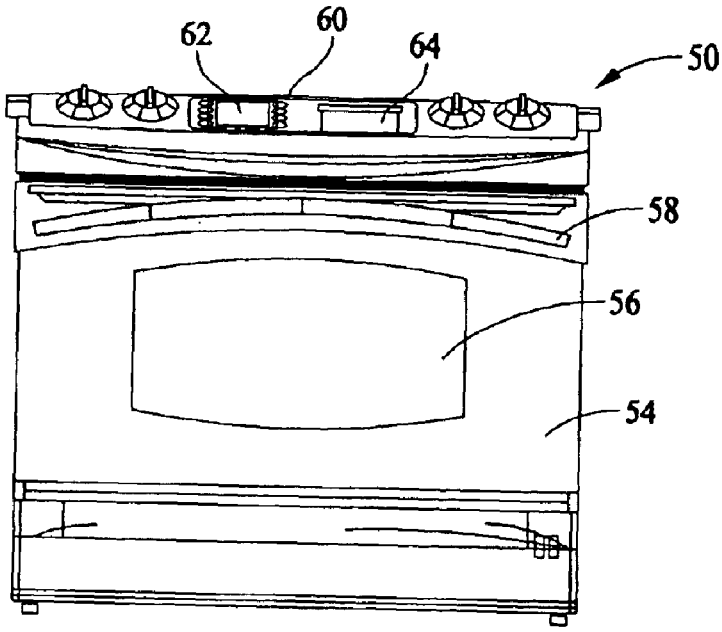
FIG. 5 is a front view of a speedcook range.
Figure 6:
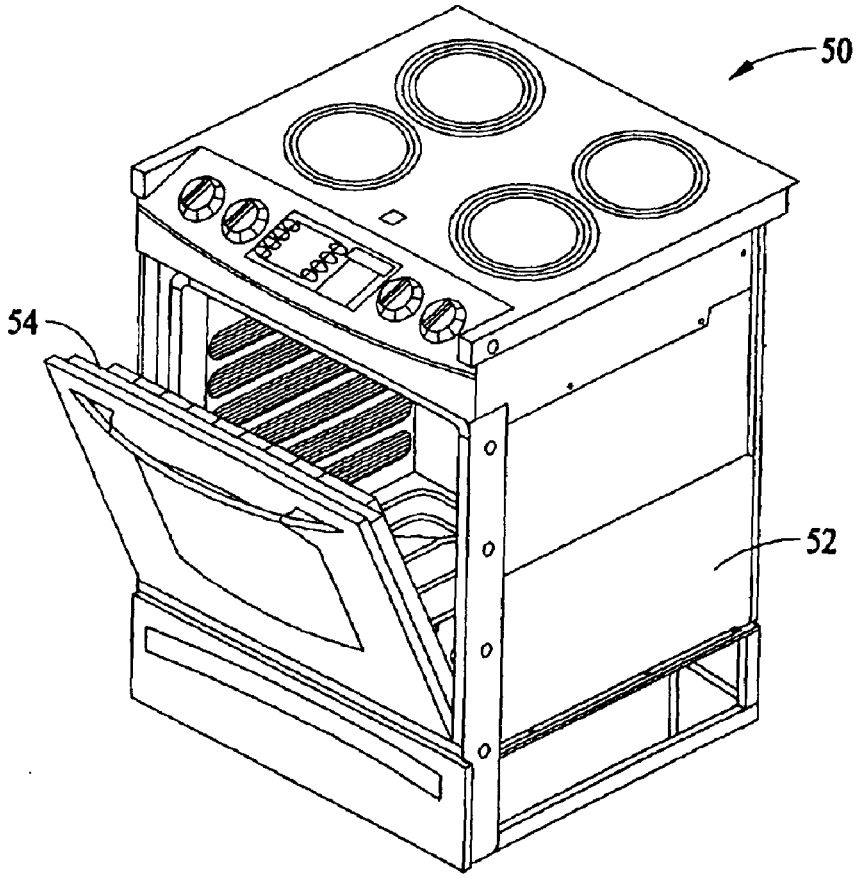
FIG. 6 is a perspective view of the oven shown in FIG. 4.
Figure 7:
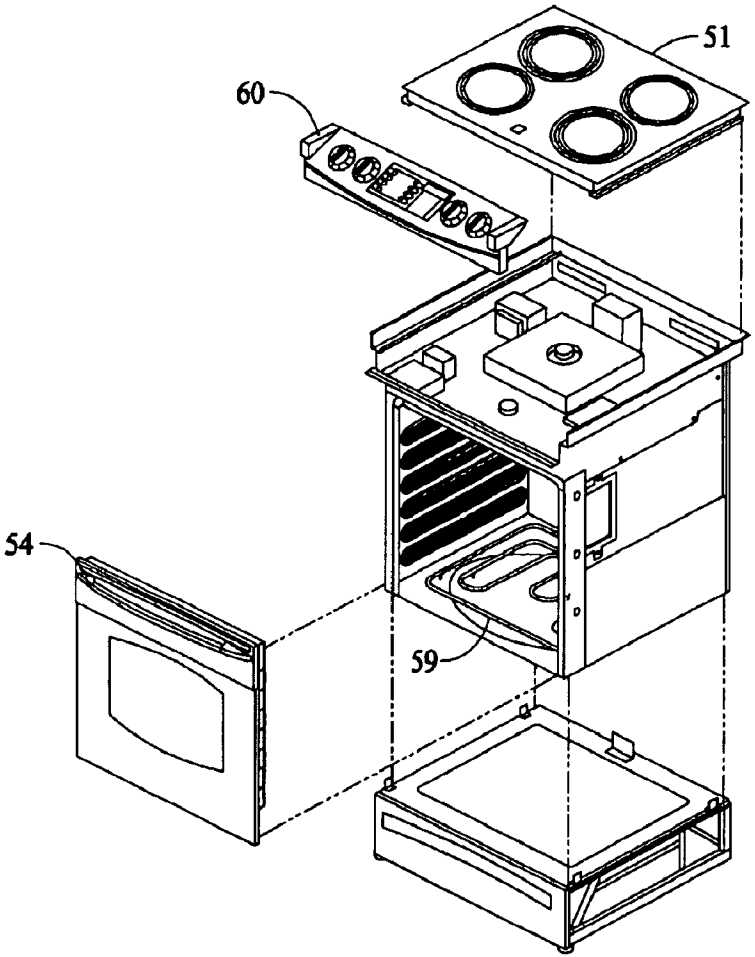
FIG. 7 is an exploded view of the oven shown in FIG. 5.

FIG. 5 is a front view of a speedcook oven 50 including a rangetop 51. FIG. 6 is a perspective view of speed cook oven 50. FIG. 7 is an exploded view of the oven shown in FIG. 5 and FIG. 6. In the exemplary embodiment, speedcook oven 50 includes an oven cavity 52, a door 54 including a window 56 provided for viewing food in oven cooking cavity 52, and a handle 58 is secured to door 54. Oven 50 also includes a control panel 60 that includes at least one display 62, a plurality of tactile control buttons 64, and various knobs or dials.

Speedcooking oven 50 includes a broil heating element (not shown), a bake heating element 59, a convection heating element (not shown), a convection fan (not shown), and a convection motor (not shown) mechanically coupled to the convection fan such that heat generated by the convection element is provided to oven cavity 52. Speedcooking oven 50 also includes a magnetron (not shown) and a thermistor (not shown) configured to sense the temperature within cavity 52. In the exemplary embodiment, the broil heating element is located at a top area inside speedcooking oven 50 and bake heating element 59 is located at a bottom area inside speedcooking oven 50. The convection heating element and the convection fan are located at a back area inside speedcooking oven 50. A cover (not shown) can be provided to shield a user from the convection heating element and the convection fan. The magnetron is located approximately above the broil heating element.

The magnetron generates microwave energy to speed cook various food items, which are supported by a rack (not shown). The microwaves are evenly distributed inside speedcooking oven 50 by a microwave disbursement plate (not shown) positioned between the magnetron and the broil heating element. Door 54 of speedcooking oven 50 allows access to speedcooking oven 50. In the exemplary embodiment, speedcooking oven 50 also includes control panel 20 shown in FIG. 4.

In use, cooking selections are made by depressing tactile control buttons 24 and when the desired selection is displayed, pressing a start button. For example, many cooking algorithms can be preprogrammed in the oven memory for many different types of foods. When a user is cooking a particular food item for which there is a preprogrammed cooking algorithm, the preprogrammed cooking algorithm is selected by operating the control buttons 64 until the selected food name is displayed and then pressing a start button. Instructions and selections are displayed on the display.

Figure 8:
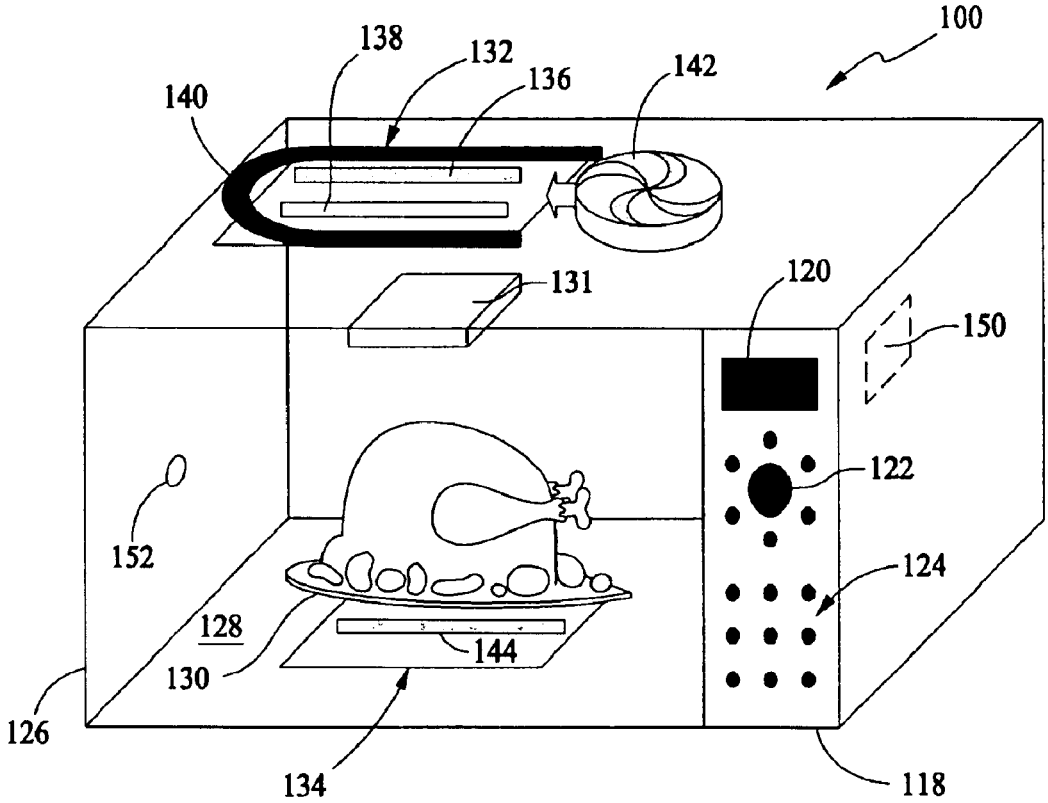
FIG. 8 is another exemplary embodiment of a speedcooking oven that can be used with the methods described herein

FIG. 8 is a front view of an over the range type oven 100 that includes a control panel 118 that includes a display 120, at least one injection molded knob or dial 122, and a plurality of tactile control buttons 124.

In use, cooking selections are made by rotating dial 122 clockwise or counter-clockwise and when the desired selection is displayed, pressing dial 122. For example, many cooking algorithms can be preprogrammed in the oven memory for many different types of foods. When a user is cooking a particular food item for which there is a preprogrammed cooking algorithm, the preprogrammed cooking algorithm is selected by rotating dial 122 until the selected food name is displayed and then pressing the dial. Instructions and selections are displayed on vacuum fluorescent display 120. The following functions can be selected from respective key pads 124 of panel.

Speedcooking oven 100 also includes a shell 126, and a cooking cavity 128 located within shell 126. Cooking cavity 128 is constructed using high reflectivity (e.g., 72% reflectivity) stainless steel, and a turntable 130 is located in cavity 128 for locating food. Oven 100 includes a microwave module 131, an upper heater module 132, and a lower heater module 134. Microwave module 131 includes a magnetron located on a side of cavity. Magnetron, in an exemplary embodiment, delivers a nominal 900 W into cavity according to standard IEC (International Electromechanical Commission) procedure. Upper heater module 132 includes radiant heating elements illustratively embodied as a ceramic heater 136 and a halogen cooking lamp 138. In the exemplary embodiment, ceramic heater 136 is rated at 600 W and halogen cooking lamp 138 is rated at 500 W. Upper heater module 132 also includes a sheath heater 140. In the exemplary embodiment, sheath heater 140 is rated at 1100 W. A convection fan 142 is provided for blowing air over heating elements and into cooking cavity 128. Lower heater module 134 includes at least one radiant heating element illustrated as a ceramic heater 144 rated at 375 W.

The specific heating elements and RF generation system (e.g., a magnetron) can vary from embodiment to embodiment, and the elements and system described above are exemplary only. For example, upper heater module 132 can include any combination of heaters including combinations of halogen lamps, ceramic lamps, and/or sheath heaters. Similarly, lower heater module 134 can include any combination of heaters including combinations of halogen lamps, ceramic lamps, and/or sheath heaters. In addition, the heaters can all be one type of heater. The specific ratings and number of lamps and/or heaters utilized in upper heater module 132 and lower heater module 134 can vary from embodiment to embodiment. Generally, the combinations of lamps, heaters, and RF generation system is selected to provide the desired cooking characteristics for speedcooking, microwave, and convection/bake modes.

Speedcooking oven 100 also includes a temperature sensor 150 located at least partially within shell 126 and a microprocessor 152 configured to receive an input from temperature sensor 150, and is also configured to operate various components of oven 100, such as, but not limited to, upper heater module 132, lower heater module 134, convection fan 142, and the magnetron. Microprocessor 152 is programmed to perform functions described herein, and as used herein, the term microprocessor is not limited to just those integrated circuits referred to in the art as microprocessors, but broadly refers to computers, processors, microcontrollers, microcomputers, programmable logic controllers, application specific integrated circuits, and other programmable logic circuits, and these terms are used interchangeably herein.

Figure 9:
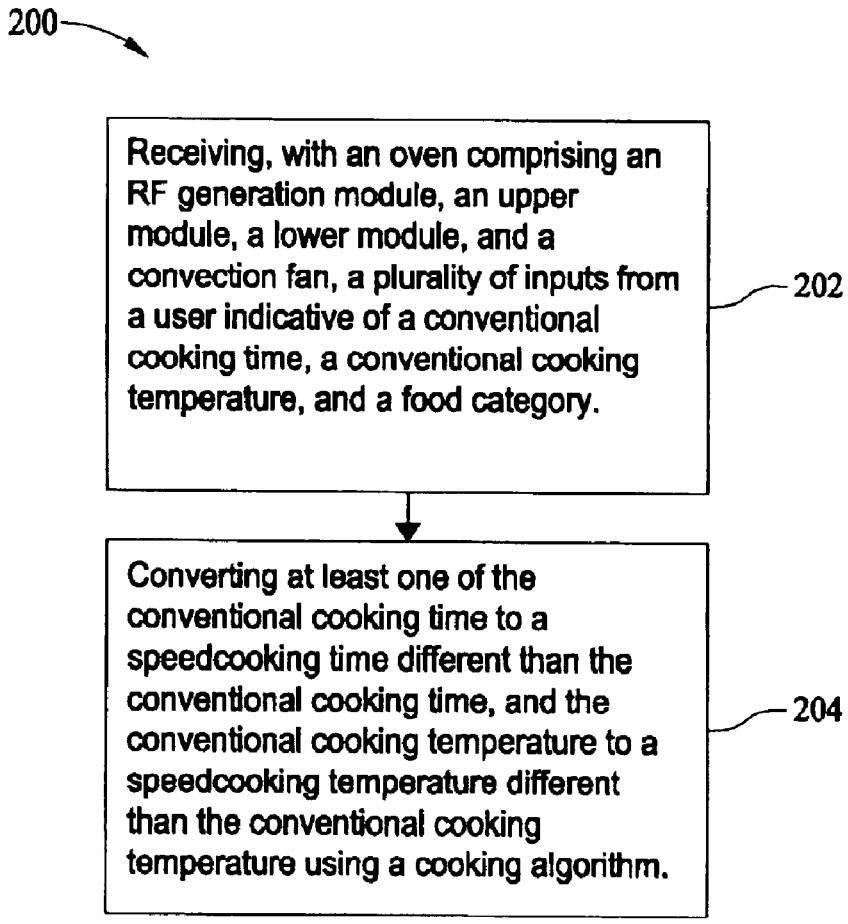
FIG. 9 illustrates an exemplary method for operating the ovens shown in FIGS. 1, 4, and 8.

FIG. 9 is an exemplary embodiment of a method 200 for operating at least one of oven 10, oven 50, and oven 100. Method 200 includes receiving 202 a plurality of inputs from a user indicative of a conventional cooking time, a conventional cooking temperature, and a food category and converting 204 at least one of the conventional cooking time to a speedcooking time different than the conventional cooking time, and the conventional cooking temperature to a speedcooking temperature different than the conventional cooking temperature using a cooking algorithm.

In use, an operator enters a plurality of inputs, such as, but not limited to, a conventional cooking time, a conventional cooking temperature, and a food category into the oven controls. The microprocessor then generates a cooking algorithm based on the inputs. In an exemplary embodiment, the food categories include categories, such as, but not limited to, a baked goods category, a vegetable casserole category, a poultry/seafood category, a meat category, a bread category, and a frozen foods category. In the exemplary embodiment, the algorithm automatically generates at least one of a speedcooking time and a speedcooking temperature based on the selected category, the operator inputted cooking time, and operator inputted cooking temperature. Additionally, the algorithm determines which cooking elements to cycle and whether the convection fan is activated. In another embodiment, the algorithm automatically generates at least one of a speedcooking time different than the input time and a speedcooking temperature different than the input cooking temperature based on the selected category. In other words, the algorithm automatically changes at least one of the cooking time or the cooking temperature based on the selected food category. In another embodiment, the algorithm changes both the cooking time and the cooking temperature based on the selected food category.

FIGS. 10A–10D are an illustration of exemplary algorithms that are employed based on the food category and cooking time. In the exemplary embodiment, the algorithms facilitate cooking food in the selected category between approximately 1.3 times and approximately 5 times faster than the time used to cook the same food in a conventional oven. For example, an operator selects a "baked goods" food category. The operator then enters a cooking temperature and a cooking time based on the operator's knowledge of conventional oven cooking operations.

For example, if the operator enters a conventional, also referred to herein as a standard, cooking time and temperature, the algorithm automatically calculates an equivalent speedcooking time and begins to count it down from when the algorithm is initiated. In the exemplary embodiment, the algorithm separates the cooking time into a plurality of cooking stages, wherein at each cooking stage, the algorithm determines the appropriate cooking elements to cycle, i.e. the convection fan, the heating elements, and the magnetron. For example, when the operator selects a frozen foods category and enters a cooking time greater than forty minutes, the cooking algorithm includes three stages to prepare the frozen foods in less than approximately one-half the conventional cooking time (convention cooking time/2, i.e. $t_{cook}$). As described in FIG. 10, the first frozen food stage configures the heating elements, the convection fan, and the magnetron, into a first operational configuration when the elapsed cooking time (t) is between approximately 0 and 0.33 $t_{cook}$. The algorithm then proceeds to stage two and configures the heating elements, the convection fan, and the magnetron, into a second operational configuration when the elapsed cooking time is between approximately 0.33 $t_{cook}$ and approximately 0.5 $t_{cook}$. The algorithm then proceeds to stage three and configures the heating elements, the convection fan, and the magnetron, into a third operational configuration when the elapsed cooking time is between approximately 0.5 $t_{cook}$ and approximately $t_{cook}$. In the exemplary embodiment, the baked goods category, the frozen foods category, and the bread category, each include at least two cooking stages. Additionally, different algorithms are utilized depending on the entered conventional cooking time. For example, when the user selects Frozen Foods and the conventional cooking time is less than 23 minutes, the above described stage cooking is not employed. Rather the speedcooking time is set to be one-third of the conventional time and a single operational configuration is utilized for the entire speedcooking time.

In the exemplary embodiment, if the user opens the door during the cooking cycle, the microwave is disabled, and the cook time is paused. After the cooking time is completed, the algorithm deactivates the magnetron and enters a standby mode. In the standby mode, the algorithm waits approximately 5 minutes for the operator to enter additional cooking instructions. If no additional cooking instructions are input, the algorithm deactivates the convection fan and the heating elements.

The methods described herein facilitate allowing an operator to cook food more quickly while allowing an operator to use conventional oven parameters for cooking temperature and cooking time. Additionally, by separating the algorithm into separate food categories, the algorithm is optimized to provide optimum food quality while minimizing the bake time. Additionally, since microwave energy has a varied effect on different food categories, the quantity of microwave energy applied to the food is matched to the food. The variation in microwave power thus drives the difference in time savings for the food categories.

While the invention has been described in terms of various specific embodiments, those skilled in the art will recognize that the invention can be practiced with modification within the spirit and scope of the claims.

What is claimed is:

1. A method for operating an oven, said method comprising:

receiving in a microprocessor of an oven, a plurality of inputs from a user indicative of a conventional cooking time, a conventional cooking temperature, and a food category, wherein the oven includes an RF generation module, an upper heater module, a lower heater module, and a convection fan; and converting the conventional cooking temperature to a speedcooking temperature different than the conventional cooking temperature using a cooking algorithm.

2. A method in accordance with claim 1 wherein said converting further comprises converting at least one of the conventional cooking time to a speedcooking time different than the conventional cooking time, and the conventional cooking temperature to a speedcooking temperature different than the conventional cooking temperature using a cooking algorithm including a plurality of stages.

3. A method in accordance with claim 1 further comprising operating at least one of the RF generation module, the upper heater module, the lower heater module, and the convection fan based on the cooking algorithm.

4. A method in accordance with claim 3 wherein operating at least one of the RF generation module, the upper heater module, the lower heater module, and the convection fan based on the cooking algorithm comprises operating a magnetron, and at least one of a halogen lamp, a ceramic heater, and a sheath heater.

5. A method in accordance with claim 1 further comprising operating the oven in a plurality of modes, at least one of said modes comprising a microwave mode, a speedcook mode, and a convection/bake mode.

6. A method in accordance with claim 2 wherein using a cooking algorithm including a plurality of stages comprises using a cooking algorithm including a plurality of stages for at least one of a baked goods category, a bread category, and a frozen foods category.

7. A method in accordance with claim 2 wherein converting the conventional cooking time to a speedcooking time different than the conventional cooking time comprises converting the conventional cooking time to a speedcooking time approximately one-half shorter than the conventional cooking time.

8. A method in accordance with claim 2 wherein converting the conventional cooking time to a speedcooking time different than the conventional cooking time comprises converting the conventional cooking time to a speedcooking time approximately three-quarters shorter than the conventional cooking time.

9. A method in accordance with claim 1 wherein said receiving in a microprocessor of an oven, a plurality of inputs from a user indicative of a conventional cooking time further comprises receiving an input indicative of a convection heating element.

10. An oven comprising:

a cooking cavity;

an RF generation module positioned to deliver microwave energy into said cooking cavity;

an upper heater module positioned within said cooking cavity;

a lower heater module positioned within said cooking cavity;

a convection heating element positioned within said cooking cavity;

a convection fan positioned within said cooking cavity; and a microprocessor operatively connected to said RF generation module, said upper module, said lower module, said convection heating element, and said convection fan, said microprocessor configured to:

receive a plurality of inputs from a user indicative of a conventional cooking time, a conventional cooking temperature, and a food category; and convert the conventional cooking time to a speedcooking time different than the conventional cooking time, and the conventional cooking temperature to a speedcooking temperature different than the conventional cooking temperature using a cooking algorithm.

11. An oven in accordance with claim 10 wherein said microprocessor is further configured to convert at least one of the conventional cooking time to a speedcooking time different than the conventional cooking time, and the conventional cooking temperature to a speedcooking temperature different than the conventional cooking temperature using a cooking algorithm including a plurality of stages.

12. An oven in accordance with claim 10 wherein said microprocessor is further configured to operate at least one of the RF generation module, the upper module, the lower module, and the convection fan based on the cooking algorithm.

13. An oven in accordance with claim 10 wherein said microprocessor is further configured to operate a magnetron, and at least one of a halogen lamp, a ceramic heater, and a sheath heater.

14. An oven in accordance with claim 10 wherein said microprocessor is further configured to operate the oven in a plurality of modes, at least one of said modes comprising a microwave mode, a speedcook mode, and a convection/bake mode.

15. An oven in accordance with claim 10 wherein to use a cooking algorithm including a plurality of stages said microprocessor is further configured use a cooking algorithm including a plurality of stages for at least one of a baked goods category, a bread category, and a frozen foods category.

16. An oven in accordance with claim 10 wherein to convert the conventional cooking time to a speedcooking time different than the conventional cooking time, said microprocessor is further configured to convert the conventional cooking time to a speedcooking time approximately one-half shorter than the conventional cooking time.

17. An oven in accordance with claim 10 wherein to convert the conventional cooking time to a speedcooking time different than the conventional cooking time, said microprocessor is further configured to convert the conventional cooking time to a speedcooking time approximately three-quarters shorter than the conventional cooking time.

18. A microprocessor electrically coupled to an oven, said microprocessor programmed to:

receive in a processor of the oven, a plurality of inputs from a user indicative of a conventional cooking time, a conventional cooking temperature, and a food category, said oven including an RF generation module, an upper module, a lower module, and a convection fan;

convert the conventional cooking temperature to a speedcooking temperature different than the conventional cooking temperature using a cooking algorithm;

operate at least one of the RF generation module, the upper module, the lower module, and the convection fan based on the cooking algorithm; and periodically update the cooking algorithm during a cooking cycle.

19. An oven in accordance with claim 18 wherein said microprocessor is further configured to operate a magnetron, and at least one of a halogen lamp, a ceramic heater, and a sheath heater.

20. An oven in accordance with claim 18 wherein said microprocessor is further configured to operate the oven in a plurality of modes, at least one of said modes comprising a microwave mode, a speedcook mode, and a convection/bake mode.

21. An oven in accordance with claim 18 wherein said microprocessor is further configured to convert at least one of the conventional cooking time to a speedcooking time different than the conventional cooking time, and the conventional cooking temperature to a speedcooking temperature different than the conventional cooking temperature using a cooking algorithm including a plurality of stages.

* * * * *